US011805834B2

(12) United States Patent
Keller

(10) Patent No.: US 11,805,834 B2
(45) Date of Patent: Nov. 7, 2023

(54) BALL CAP WITH CONCEALED OPENING

(71) Applicant: Infinity Headwear & Apparel, LLC, Lowell, AR (US)

(72) Inventor: Doug Keller, Rogers, AR (US)

(73) Assignee: Infinity Headwear & Apparel, LLC, Lowell, AR (US)

( * ) Notice: Subject to any disclaimer, the term of this patent is extended or adjusted under 35 U.S.C. 154(b) by 26 days.

(21) Appl. No.: 17/443,800

(22) Filed: Jul. 27, 2021

(65) Prior Publication Data

US 2023/0031337 A1 Feb. 2, 2023

(51) Int. Cl.

| | |
|---|---|
| ***A42C 5/02*** | (2006.01) |
| ***A42B 1/004*** | (2021.01) |
| ***A42B 1/22*** | (2006.01) |
| ***A42C 1/08*** | (2006.01) |

(52) U.S. Cl.

CPC ..... *A42B 1/225* (2013.01); *A42C 5/02* (2013.01)

(58) Field of Classification Search

CPC ..... A42B 1/225; A42B 1/22; A42B 1/019; A42C 5/02

See application file for complete search history.

(56) References Cited

U.S. PATENT DOCUMENTS 5,321,854 A * 6/1994 Kronenberger ..... A42B 1/225 2/209.3
5,509,145 A * 4/1996 Stevenson ..... A42B 1/225 2/171.4
5,615,415 A * 4/1997 Beckerman ..... A42B 1/22 2/195.3
5,724,676 A * 3/1998 Amendolia ..... A42B 1/22 2/418
5,875,494 A * 3/1999 Garnier, Jr. ..... A42B 1/225 2/171.5
5,926,850 A * 7/1999 Han ..... A42B 1/22 2/195.3
6,067,658 A * 5/2000 Cho ..... A42C 5/02 2/200.1
6,119,273 A * 9/2000 Cho ..... A42C 5/02 2/200.1
6,202,219 B1 * 3/2001 Cheever ..... A42B 1/22 2/175.1
6,363,537 B1 * 4/2002 Park ..... A42B 1/22 2/181.2
7,174,572 B1 * 2/2007 Diamond ..... A42C 5/02 2/181
7,178,172 B2 * 2/2007 Laing ..... A42B 1/225 132/273
7,945,971 B2 * 5/2011 Garza ..... A42B 1/225 2/171.4
D670,068 S * 11/2012 Bomze ..... D2/889
8,388,164 B2 3/2013 Waters (Continued)

FOREIGN PATENT DOCUMENTS

JP 2018119239 8/2018

*Primary Examiner* — Heather Mangine
(74) *Attorney, Agent, or Firm* — David R. Conklin; Kirton McConkie

(57) ABSTRACT

A ball cap with a concealed opening that allows for a greater variety of hairstyles to be worn while simultaneously retaining the general shape, appearance, and functionality of a typical ball cap. The concealed opening is hidden in a default configuration of the hat, but it can be selectively opened to allow for hair such as a ponytail to pass through.

8 Claims, 3 Drawing Sheets

(56) References Cited

U.S. PATENT DOCUMENTS

D707,018 S * 6/2014 Hart ..... D2/882
9,456,650 B1 * 10/2016 Boyce ..... A42C 5/02
D901,845 S * 11/2020 Chen ..... D2/882
11,219,261 B1 * 1/2022 Thomas ..... A42B 1/225
D948,174 S * 4/2022 Putnam ..... D2/882
2004/0060099 A1 * 4/2004 Park ..... A42B 1/22 2/195.4
2004/0103468 A1 * 6/2004 Park ..... A42C 5/02 2/181
2006/0057918 A1 * 3/2006 Burnett ..... A42B 1/019 442/376
2006/0206984 A1 * 9/2006 Jaye ..... A42B 1/225 2/209.3
2013/0074246 A1 * 3/2013 Rogers ..... A42B 1/225 2/209.3
2014/0082826 A1 * 3/2014 Kuthari ..... A42B 1/225 2/171.7
2014/0130235 A1 * 5/2014 Johnson ..... A42B 1/225 2/209.3
2015/0197324 A1 * 7/2015 Marlin ..... B63C 11/04 2/2.15
2015/0342280 A1 * 12/2015 James ..... A42B 1/225 2/172
2016/0000172 A1 * 1/2016 Cho ..... A42B 1/0182 2/181
2017/0020222 A1 * 1/2017 Arnott ..... A42B 1/225
2017/0303611 A1 * 10/2017 Hussey ..... A41D 13/012
2018/0266028 A1 * 9/2018 Hwang ..... D06C 23/00
2018/0271196 A1 * 9/2018 Hussey ..... A42B 1/048
2018/0325200 A1 * 11/2018 Tunison ..... A42C 1/00
2018/0325201 A1 11/2018 Johnson
2019/0009496 A1 * 1/2019 Trouba ..... B32B 27/40
2019/0365006 A1 * 12/2019 Lim ..... A42B 1/002
2020/0214382 A1 * 7/2020 Dann ..... A42B 1/225
2020/0297056 A1 * 9/2020 Loaiza-Wulff ..... A42B 1/225
2020/0390180 A1 * 12/2020 Keller ..... G06Q 10/063118
2021/0259346 A1 * 8/2021 Hodgdon ..... A42B 1/22
2021/0321707 A1 * 10/2021 Lord ..... A42B 1/225
2021/0378867 A1 * 12/2021 Schoenberg ..... A42B 1/04
2021/0401101 A1 * 12/2021 Miller ..... A42B 1/12
2022/0022584 A1 * 1/2022 Yim ..... A42B 1/225
2022/0061442 A1 * 3/2022 Rymer ..... A42B 1/22
2022/0061443 A1 * 3/2022 Kountz ..... A42B 1/22
2022/0167702 A1 * 6/2022 Hawkins ..... A42B 1/225

* cited by examiner

BALL CAP WITH CONCEALED OPENING

BACKGROUND OF THE INVENTION

Field of the Invention

The present invention relates to activewear apparel, and more particularly to baseball caps that can be worn with a wider variety of hair styles.

Background and Related Art

Traditional baseball caps are a staple of American fashion. They are often worn outdoors or at sporting events because of their iconic shape and appearance, as well as their usefulness in shading the wearer's eyes from the sun. In general, however, baseball caps are unaccommodating to many hair styles, in particular hair styles frequently worn by women, including pony tails, braids, and buns. Often, if a person wants to wear a pony tail with a baseball cap, the pony tail must be very low on that person's head so that it can exit the ball cap through the arched opening at the base of the back of the hat.

Some hats have been designed to accommodate a wider variety of hair styles by including holes cut into the fabric of the hat, large gaps that leave a large portion of the wearer's head exposed, or removable panels that change the shape and appearance of the hat. These designs, however, fail to allow for a greater variety of hairstyles while simultaneously retaining the shape, appearance, and functionality of a typical ball cap, and they can also decrease the structural integrity of the ball cap or remove some functionality from the ball cap.

For these reasons, there are significant limitations to the current technology in the ball cap industry. These limitations remain unaddressed and limit the hairstyle options available to those who wish to wear a ball cap. The present invention addresses and overcomes these limitations.

BRIEF SUMMARY OF THE INVENTION

The instant invention is a ball cap with a concealed opening that allows for a greater variety of hairstyles to be worn while simultaneously retaining the general shape, appearance, and functionality of a typical ball cap. The concealed opening is hidden in a default configuration of the hat, but it can be selectively opened to allow for hair such as a ponytail to pass through.

According to some implementations of the invention, the invention is a ball cap comprising a crown and a visor. The crown can be comprised of a front panel, a back panel, a left-side panel interposed between the front panel and the first half of the back panel, and a right-side panel interposed between the front panel and the second half of the back panel. The back panel can have a first half and a second half, and each half can comprise one or more panel segments. The front panel, right-side panel, and left-side panel can each be comprised of a single panel, wherein each single panel can comprise one or more panel segments. The crown further can have a tip, at which the upper portions of the front panel, the back panel, the left-side panel, and the right-side panel meet.

According to some implementations, the first and second halves of the back panel come together such that there is an arched opening in the back panel, the arched opening having an apex. The first and second halves of the back panel can be joined together at least at a location near the apex of the arched opening and at a location near the tip of the crown.

According to some implementations, the crown further comprises a sweatband positioned opposite the tip, defining an opening for the crown. A portion of the sweatband can be a backstrap that extends across the arched opening in the back panel. The backstrap can be adjustable, which congruently can adjust the circumference of the sweat band to fit a variety of head shapes and sizes.

According to some implementations, the back panel also has a concealed opening. The concealed opening can be between the first and second halves of the back panel. According to some embodiments, the first and second halves can have an overlapped interface, and the concealed opening can be between the overlapped interface of each half, thus allowing the overlapped interface to selectively conceal the opening. The concealed opening can extend at least part of the way between the tip and the apex of the arched opening. The concealed opening may be selectively opened to provide a passageway through the back panel.

In many implementations, the concealed opening is positioned between the tip and the arched opening, but it does not form a part of the arched opening. This allows for the aesthetically recognizable arched opening feature of the hat to exist along with the concealed opening whether the concealed opening is concealed (the default configuration) or opened to allow for passage of hair or other objects through the passageway (the open configuration). As an example, the two halves of the back panel can be attached (e.g., with a permanent attachment such as stitching) at a point above the apex of the arched opening and at a point near the tip of the crown, but they can be unattached (or impermanently attached) between the two attachment points, thereby defining the concealed opening.

According to some implementations, the ball cap can also comprise one or more recognizable ball cap features, such as one or more eyelets, top buttons, logos, seam stitching, stitching tape, or visor stitching. Thus, the ball cap can further resemble a typical ball cap while providing the increased functionality offered by the concealed opening (e.g., allowing ponytails, buns, or braids to pass through).

According to some implementations, the sweatband is coated with a protective coating. Such a coating can protect the ball cap from sweat, makeup, oils, or other substances that may come into contact with the inner surface of the ball cap. According to some implementations, the protective coating is polyurethane.

According to some implementations, the sweatband can further be made from a material that can protect the cap from sweat or makeup. The material can be any material that can absorb or repel sweat or is resistant to makeup stains. The material can be polyurethane.

According to some implementations, the concealed opening further comprises an adherence material to increase a friction coefficient between the overlapped interface of the first and second halves of the back panel. Thus, the adherence material causes the opening to remain concealed in its default configuration, but, when desired, the concealed opening can be selectively opened to create a passageway through the back panel, allowing objects such as hair to pass through.

According to some implementations, the adherence material can be a coating that increases the friction coefficient between the overlapped interface of the first and second halves of the back panel, such as a polyurethane coating or a silicone coating. In some embodiments, the adherence material is comprised of a fabric of polymer-based material.

In some embodiments, the adherence material is a fastener such as a hook and loop fastener, buttons, snaps, clips, ties, a zipper, or another fastener.

According to some implementations, the ball cap can be at least partially coated with a protective coating. In particular, certain parts of the ball cap or the entire ball cap could be coated. For example, the crown could be coated with a protective coating, or the visor, or the sweatband, or any combination of these elements. The protective coating could be polyurethane, or it could be another coating capable of protecting the cap from sweat, oil, makeup, or any other substance that might come into contact with the ball cap.

According to some implementations, certain parts of the hat are constructed with a material capable of protecting the hat. The material can be a polyurethane material such as a polyurethane laminate (PUL). As an example, the sweatband could be constructed (all or in part) with PUL, while the rest of the cap could be constructed with PUL or with other materials.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

The instant invention is a ball cap with a concealed opening that allows for a greater variety of hairstyles to be worn while simultaneously retaining the general shape, appearance, and functionality of a typical ball cap. The concealed opening is generally hidden in a default (closed) configuration of the hat, but it can be selectively opened to allow for objects, such as a ponytail, bun, or braid, ribbon, or other hairstyle or object to pass through.

Figure 1:
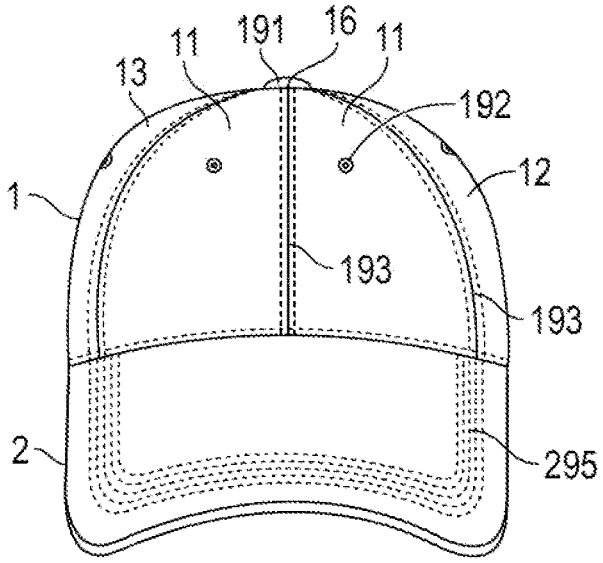
FIG. 1 shows a frontal view of the ball cap, in accordance with a representative embodiment of the present invention.
Figure 2:
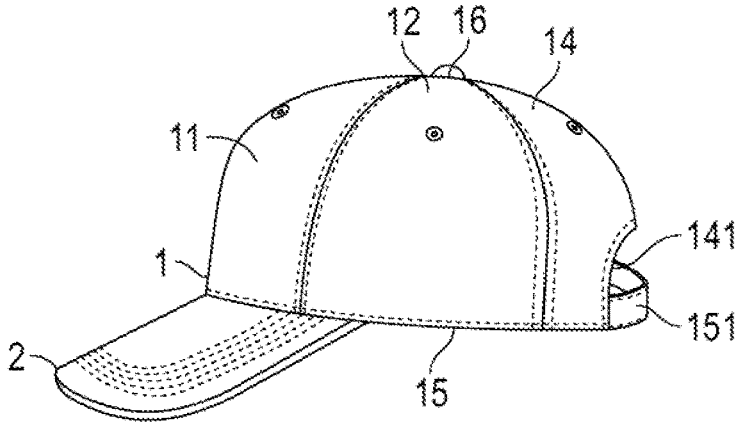
FIG. 2 shows a side view of the ball cap, in accordance with a representative embodiment of the present invention.

Referring to FIGS. 1 and 2, according to some implementations of the invention, the invention is a ball cap comprising a crown 1 and a visor 2. The crown 1 can be comprised of a back panel 14, which can have a first half and a second half, a front panel 11, a left-side panel 12 interposed between the front panel 11 and the first half of the back panel 14, and a right-side panel 13 interposed between the front panel 11 and the second half of the back panel 14. Any of the front panel 11, left side panel 12, right side panel 13, first half of the back panel, and second half of the back panel, or any combination of the above, can be comprised of or more panels or panel segments. For example, the front panel 11 can be comprised of a first panel segment and a second panel segment, with the first panel segment interposed between the second panel segment and the right side panel 13, and with the second panel segment interposed between the first panel segment and the left side panel 12. Any such panel segments can be joined together, such as with seam stitching or another form of attachment, to form a panel. The crown 2 further can have a tip 16, at which the upper portions of the front panel 11, the back panel 14, the left-side panel 12, and the right-side panel 13 meet.

Figure 3:
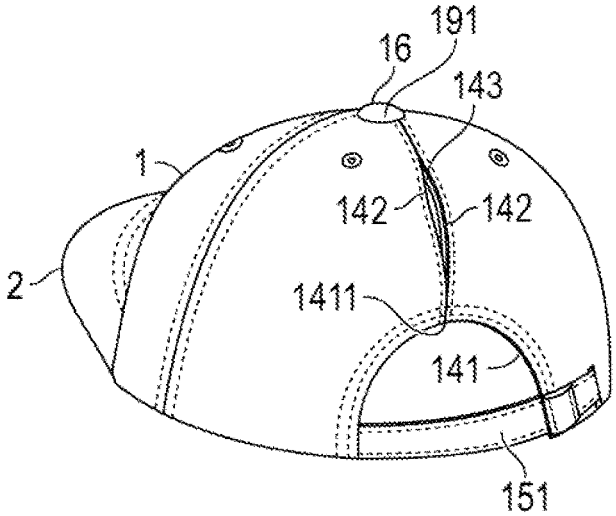
FIG. 3 shows a rear perspective view of the ball cap, with the overlapping interface on the first and second halves of the back panel spaced apart to afford a view of the concealed opening, in accordance with a representative embodiment of the present invention.

Referring now to FIGS. 2 and 3, according to some implementations, the first and second halves of the back panel 14 come together such that there is an arched opening 141 in the back panel 14, the arched opening 141 having an apex 1411. The first and second halves of the back panel 14 can be joined together at least at a location near the apex 1411 of the arched opening 141 and at a location near the tip 16 of the crown 1. Thus, the characteristic shape of the arched opening 141 is maintained and not disrupted by other features of the cap.

With reference to FIGS. 2 and 3, according to some implementations, the crown 1 further comprises a sweatband 15 positioned opposite the tip 16, defining an opening for the crown 1. A portion of the sweatband 15 can be a backstrap 151 that extends across the arched opening 141 in the back panel 14. The backstrap 151 can be adjustable, which congruently can adjust the circumference of the sweat band 15 to fit a variety of head shapes and sizes. The backstrap 151 can also be comprised of multiple pieces that are attached together, such as by a buckle, snap, hook-and-loop fastener, buttons, braids, snaps, or other fasteners.

With reference to FIG. 3, according to some implementations, the back panel 14 further comprises a concealed opening 142. The concealed opening 142 can be between the first and second halves of the back panel 14. According to some embodiments, the first and second halves can have an overlapped interface 143, and the concealed opening 142 can be between the overlapped interface 143 of each half, thus allowing the overlapped interface 143 to selectively conceal the opening 142. The concealed opening 142 can extend at least part of the way between the tip 16 and the apex 1411 of the arched opening 141. The concealed opening 142 may be selectively opened to provide a passageway through the back panel 14. Because of the attachment near the apex 1411, the characteristic shape of the arched opening 141 is not disrupted by the concealed opening 142.

Figure 4:
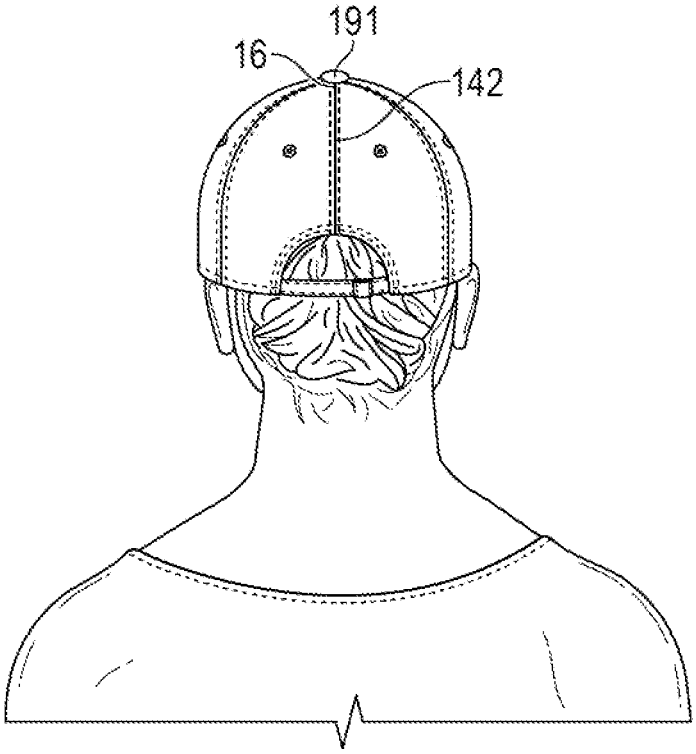
FIG. 4 shows a rear view of the ball cap on a user's head with the concealed opening concealed by the overlapping interface, in accordance with a representative embodiment of the present invention.
Figure 6:
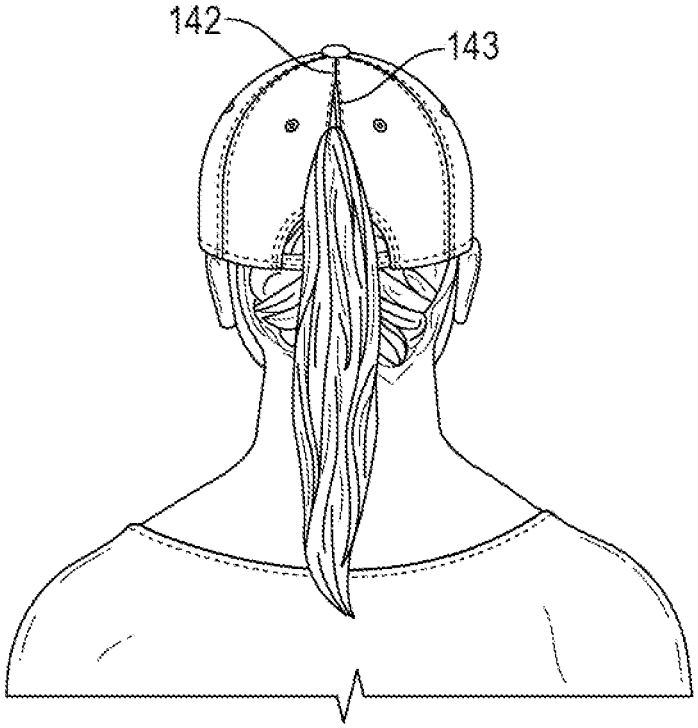
FIG. 6 shows a rear view of the ball cap on a user's head with a ponytail passing through the opening, in accordance with a representative embodiment of the present invention.

Referring now to FIGS. 4 and 6, in some embodiments the cap can have a default (closed) configuration, where the concealed opening 142 is concealed, and a modified configuration (open), where the concealed opening 142 is visible. FIG. 4 shows an example of the closed configuration, where the concealed opening 142 is not visible because it is covered by the overlap of the overlapping interface 143. In some embodiments, there is faux stitching near the overlapping interface 143 on each half of the back panel 14. Thus, in the default configuration, the cap may appear to have a typical seam with seam stitching 193 between the two halves of the back panel 14. FIG. 6 shows an example of the modified (open) configuration, where the overlapping interface 143 on each half of the back panel 14 is spread apart so that an object (i.e., hair) can pass through the concealed opening 142.

Figure 5:
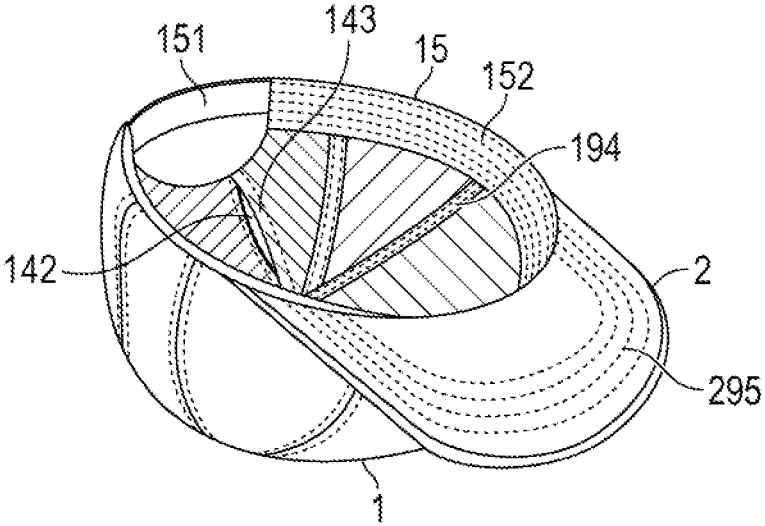
FIG. 5 shows a bottom perspective view of the ball cap, with the overlapping interface on the first and second halves of the back panel spaced apart to afford a view of the concealed opening, in accordance with a representative embodiment of the present invention.

Referring now to FIG. 5, according to some implementations, the sweatband 15 has an inner portion 152 that is at least partially coated with a protective coating. Such a coating can protect the ball cap from sweat, makeup, oils, or other substances that may come into contact with the inner surface of the ball cap. According to some implementations, the protective coating is polyurethane. In particular, in some embodiments the inner portion 152 makes up part of the inner surface of the cap along the perimeter of the sweatband 15, except that the inner portion need not extend across the backstrap 151. The inner portion 152 or the whole sweatband 15 can be coated with or made from a material that can protect the cap from sweat or makeup. An example of such a material is polyurethane or polyurethane laminate (PUL).

Referring now to FIGS. 3-7, according to some implementations, the concealed opening 142 further comprises an adherence material to increase a friction coefficient between the overlapped interface 143 of the first and second halves of the back panel. Thus, the adherence material causes the opening 142 to remain concealed in its default configuration, but, when desired, the concealed opening 142 can be selectively opened to create a passageway through the back panel allowing objects such as hair to pass through. According to some implementations, the adherence material can be a coating that increases the friction coefficient between the overlapped interface 143 of the first and second halves of the back panel, such as a polyurethane coating or a silicone coating. In some embodiments, the adherence material is comprised of a fabric of polymer-based material. In some embodiments, the adherence material is a fastener such as a hook and loop fastener, buttons, snaps, clips, ties, a zipper, or another fastener. In some embodiments, the concealed opening 142 does not have an adherence material or other fastener to increase a friction coefficient between the overlapped interface 143 of the first and second halves of the back panel.

Figure 7:
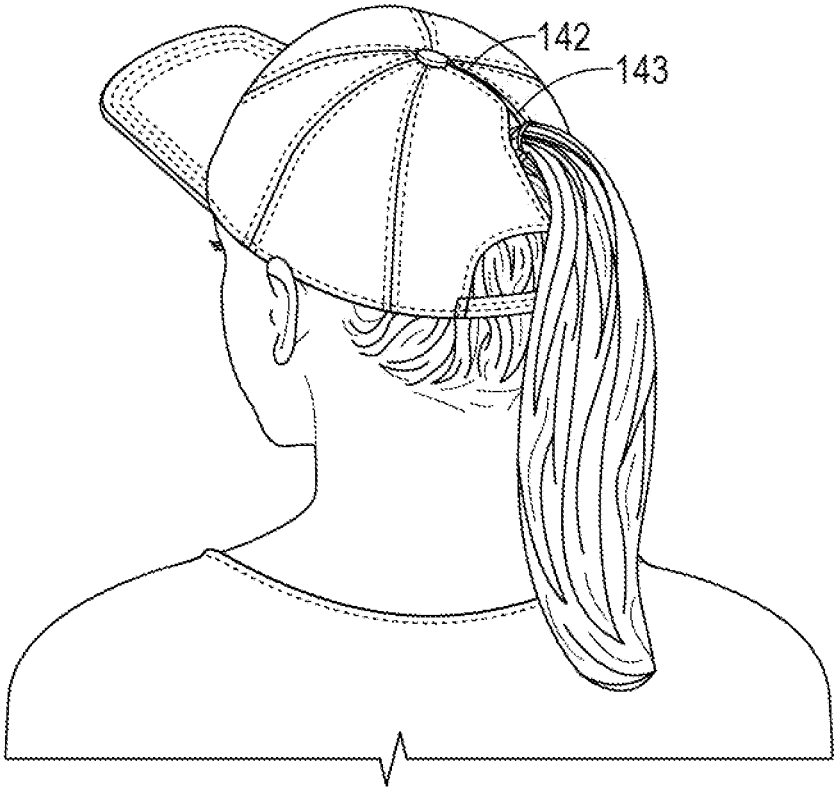
FIG. 7 shows a perspective rear view of the ball cap on a user's head with a ponytail passing through the opening, in accordance with a representative embodiment of the present invention.

In accordance with FIG. 7, in some implementations the concealed opening 143 need not extend all the way up to the tip 16. Similarly, the concealed opening 143 need not extend all the way down to the apex 1411. Rather, portions of the concealed opening 142 may be closed to further augment the traditional appearance of the cap. These portions may be permanently closed, such as by stitching together portions of the overlapping interface 143, or they may be selectively closed, such as by using a material or coating with a high friction coefficient, by using a back panel 14 sufficiently rigid to generally hold the cap in its default configuration unless opened by a force (such as by pulling apart the halves of the back panel or by an object passing through the concealed opening 142), or by using a fastener (such as a hook-and-loop fastener, ties, a zipper, buttons, or another fastener).

With reference to FIGS. 1 and 5, according to some implementations, the ball cap can also comprise one or more recognizable ball cap features, such as one or more eyelets 192, a top button 191, a logo, seam stitching 193, stitching tape 194, or visor stitching 295. Thus, the ball cap can further resemble a typical ball cap while providing the increased functionality offered by the concealed opening 142.

With reference to FIGS. 1-7, according to some implementations, the ball cap can be at least partially coated with a protective coating. In particular, certain parts of the ball cap or the entire ball cap could be coated. For example, the crown 1 could be coated with a protective coating, or the visor 2, or the sweatband 15, or any combination of these elements or other elements that are part of the ball cap. The protective coating could be polyurethane, or it could be another coating capable of protecting the cap from sweat, oil, makeup, or any other substance that might come into contact with the ball cap. According to some implementations, certain parts of the hat are constructed with a material capable of protecting the hat. The material can be a polyurethane material such as a polyurethane laminate. As an example, the sweatband can be constructed (all or in part) with polyurethane laminate.

In reference to FIG. 4, certain implementations of the invention may include a method for securing the hat to the user's head in a default (closed) configuration. Such a method may include putting the hat onto the user's head without modifying the hat from its default configuration, or it may include changing the hat from its modified configuration to its default configuration (e.g., closing a zipper, securing hook-and-loop fastener, securing another fastener, placing the overlapping interface 143 of one half of the back panel over the overlapping interface 143 of the other half of the back panel, thereby overlapping the overlapping interfaces and concealing the concealed opening 142) prior to placing the cap on the user's head.

In reference to FIG. 6, certain implementations of the invention may include a method for securing the hat to the user's head in a modified (open) configuration. Such a method may include changing the hat to a modified configuration before placing it on the user's head, such as by unzipping a zipper, unbuttoning a button, undoing a hook-and-loop fastener, or undoing another fastener, or by separating the overlapping interface 143 on each half of the back panel 14 from each other, such that the concealed opening 142 is revealed. Such a method may also include placing the cap on the user's head, then subsequently changing the hat from the default configuration to the modified configuration, such as by such as by unzipping a zipper, unbuttoning a button, undoing a hook-and-loop fastener, or undoing another fastener, or by separating the overlapping interface 143 on each half of the back panel 14 from each other, such that the concealed opening 142 is revealed. When the hat is in the open configuration, an object (such as a ponytail, a bun, a braid, ribbon, or another hair style or other object) may be placed through the concealed opening 142, thereby causing the cap to remain in the open configuration.

In reference to FIG. 7, certain implementations of the invention may include a method for securing the hat to the user's head in a partially-modified (semi-open) configuration. Such a method may include partially unzipping a zipper, unbuttoning less than all of the included buttons, partially undoing a hook-and-loop fastener, or partially undoing another fastener, or by separating a portion of the overlapping interface 143 on each half of the back panel 14 from each other, such that the concealed opening 142 is partially revealed. When the hat is in the semi-open configuration, an object (such as a ponytail, a bun, a braid, ribbon, or another hair style or other object) may be placed through the concealed opening 142, thereby causing the cap to remain in the semi-open configuration.

What is claimed is:

1. A ball cap comprising:

a crown and a visor, the crown comprising a front panel, a back panel having a first half with a first inner edge and a second half with a second inner edge, a left-side panel interposed between the front panel and the first half of the back panel, and a right-side panel interposed between the front panel and the second half of the back panel, the first and second halves of the back panel forming an arched opening in the back panel, the crown further comprising a tip at which upper portions of the front panel, the back panel, the left-side panel and the right-side panel meet, the crown further comprising a sweatband positioned opposite the tip and defining an opening for the crown, a portion of the sweatband comprising a backstrap that extends across the arched opening in the back panel, the back panel further comprising a concealed vertical opening between an overlapped interface of the first inner edge and the second inner edge, said concealed vertical opening extending only partway between the tip and the arched opening, wherein the concealed vertical opening may be selectively opened to provide a passageway through the back panel, wherein the second half of the back panel comprises a continuous piece of material that terminates at the second inner edge;

wherein the overlapped interface of the first inner edge and the second inner edge along an entire length of the concealed vertical opening does not comprise a fastener or adherence material to increase a friction coefficient between the overlapped interface of the first and second halves of the back panel; and wherein the sweatband is at least partially coated with a protective coating comprised of polyurethane.

2. The ball cap as recited in claim 1, wherein the backstrap is adjustable.

3. The ball cap as recited in claim 2, wherein the backstrap further comprises:

a first strap element, a second strap element, and a fastener configured to removably attach the first strap element to the second strap element.

4. The ball cap as recited in claim 1, wherein the ball cap further comprises:

a recognizable ball cap feature selected from a group consisting of one or more of the following: an eyelet, a top button, a logo, seam stitching, stitching tape, or visor stitching.

5. The ball cap as recited in claim 1, wherein the ball cap is at least partially coated with a protective coating.

6. The ball cap as recited in claim 1, wherein the front panel comprises a first panel segment and a second panel segment.

7. The ball cap as recited in claim 1, wherein the first inner edge and the second inner edge are fixedly coupled together near an apex of the arched opening.

8. The ball cap as recited in claim 1, wherein the first inner edge is configured to be concealed by the overlapped interface, and wherein the second inner edge is exposed.

* * * * *